US006698631B1

(12) United States Patent
Haskins

(10) Patent No.: US 6,698,631 B1
(45) Date of Patent: Mar. 2, 2004

(54) JANITORIAL SUPPLY CARRIER

(76) Inventor: David E. Haskins, P.O. Box 1721, Dodge City, KS (US) 67801

( * ) Notice: Subject to any disclaimer, the term of this patent is extended or adjusted under 35 U.S.C. 154(b) by 84 days.

(21) Appl. No.: 10/170,475

(22) Filed: Jun. 12, 2002

(51) Int. Cl.[7] ..... A45F 5/00

(52) U.S. Cl. ..... 224/148.4; 224/262; 224/269; 224/628; 224/637; 224/645; 224/649; 224/656; 224/682; 224/684

(58) Field of Search ..... 224/148.1, 148.4, 224/261, 262, 269, 628, 637, 641, 645, 646, 648, 649, 654, 656, 677, 682, 684, 904

(56) References Cited

U.S. PATENT DOCUMENTS

| | | | | | |
|---|---|---|---|---|---|
| 469,444 | A | * | 2/1892 | Frazier | 224/641 |
| 860,395 | A | * | 7/1907 | Lindsey | 224/649 |
| 2,620,479 | A | | 12/1952 | Buck | |
| 3,529,307 | A | | 9/1970 | Belson et al. | |
| 4,106,121 | A | | 8/1978 | Belson | |
| 4,114,788 | A | * | 9/1978 | Zufich | 224/637 |
| 4,676,419 | A | * | 6/1987 | Victor | 224/649 |
| 5,004,136 | A | | 4/1991 | Leath | |
| 5,101,515 | A | | 4/1992 | Holt | |
| 5,152,443 | A | | 10/1992 | Hagan | |
| 5,349,706 | A | * | 9/1994 | Keer | 224/682 |
| 5,577,653 | A | * | 11/1996 | Bieker | 224/148.1 |
| 5,586,703 | A | | 12/1996 | Radar et al. | |
| 5,630,536 | A | * | 5/1997 | Bugnaski | 224/637 |
| 5,699,560 | A | | 12/1997 | Greenberg | |
| 5,815,834 | A | | 10/1998 | Bronson | |
| 5,836,497 | A | * | 11/1998 | Pelish | 224/677 |
| 5,909,802 | A | | 6/1999 | Puco et al. | |
| 5,931,363 | A | * | 8/1999 | Ammons, Jr. | 224/682 |
| 5,940,883 | A | | 8/1999 | Daoust | |
| 6,216,931 | B1 | * | 4/2001 | Trawinski | 224/904 |
| 6,295,650 | B1 | | 10/2001 | Baacke | |
| 6,398,092 | B1 | * | 6/2002 | Ansley | 224/677 |
| 6,568,575 | B1 | * | 5/2003 | Bartholomew | 224/649 |

* cited by examiner

*Primary Examiner*—Gary E. Elkins
(74) *Attorney, Agent, or Firm*—Kenneth H. Jack; Davis & Jack, LLC

(57) ABSTRACT

A worn janitorial supply carrier for even weight distribution and convenient access to carried janitorial supplies, the carrier having a back panel; left and right hip panels; left and right shoulder straps; lacings, straps and take up buckles adjustably interconnecting the back panel, the left and right hip panels, and the left and right shoulder straps; reinforcing straps extending laterally across the lower ends of the left and right hip panels; stitchings interconnecting the reinforcing straps and the left and right hip panels, the left and right hip panels, the stitchings, and the reinforcing straps defining hook receiving channels; upwardly opening bottle receptacles; and "S" hooks removably attaching upper ends of the upwardly opening bottle receptacles to the lower ends of the left and right hip panels, the "S" hooks engaging the channels.

13 Claims, 4 Drawing Sheets

JANITORIAL SUPPLY CARRIER

FIELD OF THE INVENTION

This invention relates to clothing articles adapted for carrying loads or burdens. More particularly, this invention relates to such articles adapted for carrying bottles and cans containing janitorial cleaning fluids, and the like.

BACKGROUND OF THE INVENTION

Janitorial professionals utilize numerous articles and accoutrements in the conduct of their trade. Included among such articles and accoutrements are bottled or canned cleaning supplies and sprays, including floor cleaners, counter-top cleaners, glass and mirror cleaners, furniture polishes, furniture oils, carpet cleaners, and carpet spot removers. Bottle and cans containing such fluids are known to be carried in mobile janitorial supply carts. However, such carts undesirably restrict the mobility of a janitor, and such carts typically are not economically obtained.

Variously configured belts, satchels, or harnesses for carrying such janitorial supplies are known; however, such articles typically are not economically constructed, and they typically undesirably promote unwieldy and awkward loading of the janitor.

The instant inventive janitorial supply carrier solves or ameliorates the above noted deficiencies by providing an assembly including back and hip panels, shoulder straps, and bottle or can receptacles which is economically constructed, which is easily configurable to suit the individual needs of various janitors, and which advantageously distributes loads for ease of carrying.

BRIEF SUMMARY OF THE INVENTION

A first structural component of the instant inventive janitorial supply carrier comprises a preferably substantially square back panel fitted to overlie and rest against the lower lumbar region of a janitor's back. Preferably, the back panel is fabricated to include a single layer of chemical resistant heavy duty polyester fabric. Left and right hip panels, preferably similarly fabricated from single layers of heavy duty polyester fabric, extend leftwardly and rightwardly from left and right edges of the back panel. A preferred means for interconnecting the left and right hip panels and the back panel comprises left and right lacing and eyelet combinations interconnecting rearward ends of the left and right waist panels respectively with left and right ends of the back panel. The preferred lacing and eyelet attaching means advantageously allows a wearer of the janitorial supply carrier to adjust the spacings between the back panel and the left and right hip panels, and to adjust the angular orientations of the left and right hip panels with respect to the back panel. By facilitating such two modes of adjustability, the preferred lacing and eyelet attaching means facilitates use of the carrier by janitors have varying body sizes and shapes. Suitably, strap and take up buckle plate combinations, strap and take up buckle rings combinations, strap and quick disconnect take up buckle combinations, strap and snap combinations, strap, button, and buttonhole combinations, or strap, velcro hook, and velcro pad combinations may be utilized as attaching means in place of the preferred lacing and eyelet combinations.

Preferably, strap and quick disconnect take up buckle combinations extend forwardly from the forward edges of the left and right hip panels, such combinations allowing interconnection of such panels across a wearer's abdomen area. Alternately, the above described types of attaching means which are suitable for interconnecting the back panel with the left and right hip panels may be suitably substituted for such preferred strap and quick disconnect take up buckle combinations.

Left and right shoulder straps are necessarily provided, rearward ends of the left and right shoulder straps preferably being fixedly and adjustably attached to the upper end of the back panel, and forward ends of the left and right shoulder straps being respectively fixedly and adjustably attached to upper ends of the left and right hip panels. A preferred means for fixedly and adjustably attaching the left and right shoulder straps comprises strap and take up buckle plate combinations. Means of the types described above for interconnecting the back panel and the left and right hip panels may be suitably substituted for such preferred strap and take up buckle plate combinations.

Means described above for interconnecting shoulder straps and panels cumulatively comprise a first attaching means element of the inventive carrier.

A reinforcement strap necessarily extends over the outer surface of the left or right hip panel, and preferably a pair of straps provides coverage of both hip panels. Such straps preferably extend from rear to front, and such straps are necessarily positioned at the lower ends of such panels. A second attaching means, preferably sewn stitchings, are utilized to interconnect the reinforcing straps and the left and right hip panels. Suitably, other fasteners such as rivets, staples, heat fusion bonds, and adhesive bonds may be utilized as requisite second attaching means. Necessarily, the second attaching means are positioned and configured so that such means, in combination with the outer surfaces of the left and right hip panel and the inner surfaces of the reinforcing straps, form a plurality of vertically extending hook or ring receiving channels.

A plurality of upwardly opening bottle or can receiving receptacles are necessarily provided, along with third attaching means adapted for engaging the vertically extending channels formed by the reinforcing straps. Preferably, the bottle or can receiving receptacles are fabricated similarly with the hip panels, each receptacle having a channel forming reinforcing strap attached thereto. Where such receptacle configuration is adopted, elongated "S" hooks, preferably comprising spring steel or high strength plastic, are preferably utilized for opposingly engaging the vertically extending channels formed by the panels' and receptacles' reinforcing straps. Elongated locking rings may be suitably utilized in place of the preferred elongated "S" hooks. Necessarily, the receptacles' reinforcing straps are positioned at their upper ends so that bottles or cans which they nestingly receive will extend downwardly below the lower edges of the left and right hip panels.

Preferably, the lower ends of the bottle or can receptacles comprise annularly inwardly gathered and downwardly extending hems which are drawn and held by a preferred cable tie drawing means. Suitably, other hem drawing means extending through such hems such as drawstrings or cords may be utilized. The preferred annularly inwardly gathered hems advantageously provide a means for fabrication of the floors of the receptacles which is simpler and more economical than stitching floor panels to wall panels. The preferred annularly inwardly gathered and downwardly extending hem also advantageously performs a mechanical function, preventing hard edges of bottles or cans contained within the receptacles from percussively striking and cutting the side walls of the receptacles. Upon contact of the receptacles with a surface, the downwardly extending gathered hems protectively contact the surface, preventing edges of bottles or cans from pinching and cutting the fabric.

In use of the inventive janitorial supply carrier, janitors of varying body sizes and shapes may selectively adjust the positions of the left and right hip panels, the back panel, and the left and right shoulder straps with respect to each other so that, upon donning the carrier, the weight of bottles or cans suspended from the lower ends of the left and right hip panels is evenly distributed between the janitor's shoulders and hips. Such even distribution of weight reduces fatigue from carrying of weight. The janitor may also adjustably position various bottle or can receptacles for ease and convenience of access.

Other surfaces of the straps and panels of the inventive janitorial supply carrier may be conveniently and advantageously utilized for supporting various attachment loops, pouches, or pockets for supporting and carrying other accoutrements or supplies common to the janitorial trade. For example, a scrub brush receiving loop may be fixedly attached to the left or right hip panel at a point above the lower reinforcing strap. Where the inventive janitorial supply carrier includes such other supply carrying means, the inventive carrier additionally provides for advantageous weight distribution of and convenient access to such other supplies.

Accordingly, it is an object of the present invention to provide a janitorial supply carrier comprising hip panels having reinforcing straps which dually function as bottle or can receptacle attaching means.

It is a further object of the present invention to provide such a carrier which further comprises bottle or can receptacles having floors formed of annularly inwardly drawn and downwardly extending hems.

It is a further object of the present invention to provide such a carrier which is adapted for adjustable positioning of straps and panels for accommodation of varying body shapes and sizes.

It is a further object of the present invention to provide such a carrier which is economically fabricated.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
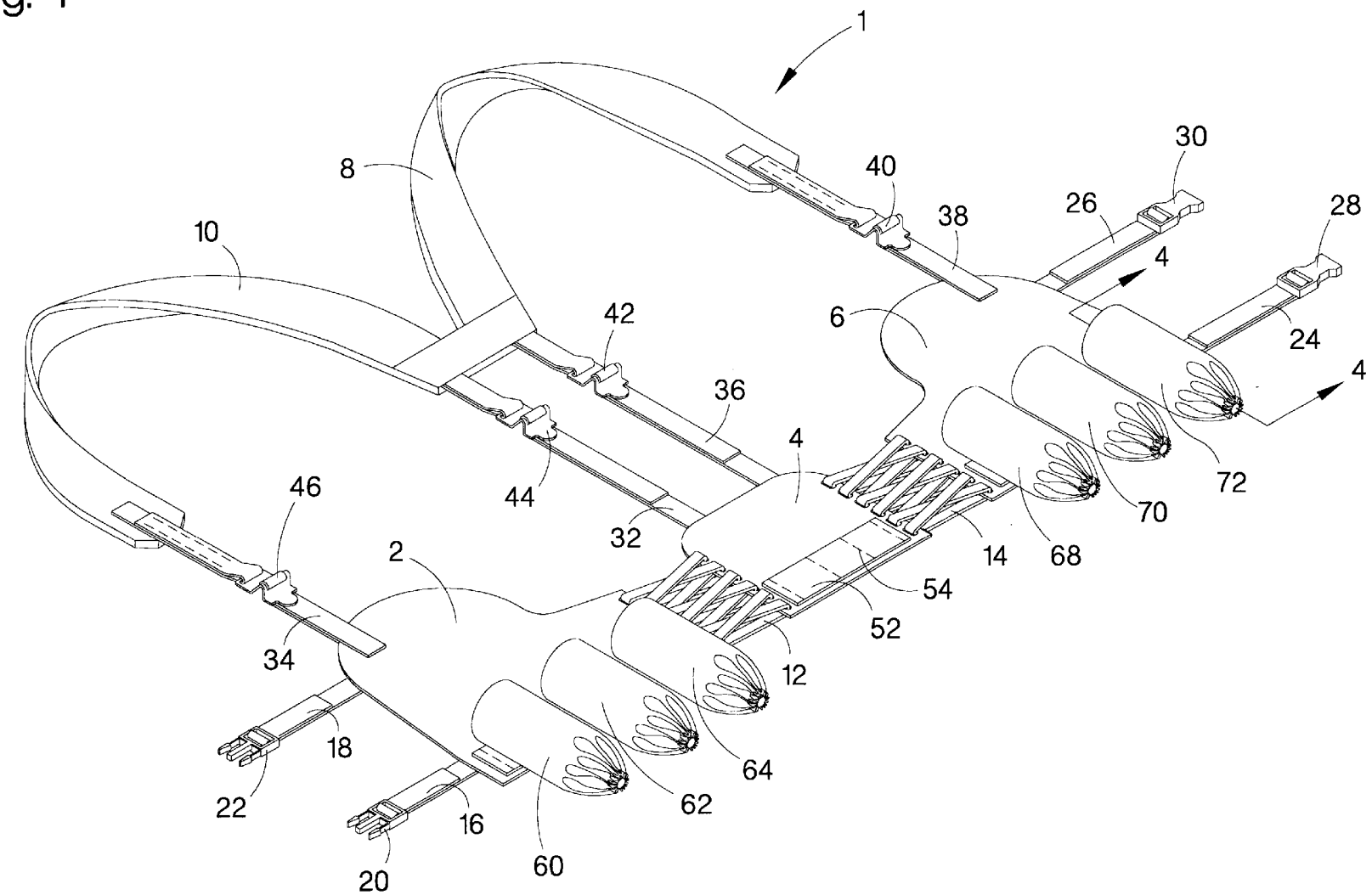
FIG. 1 is an isometric view of the instant inventive janitorial supply carrier.
Figure 2:
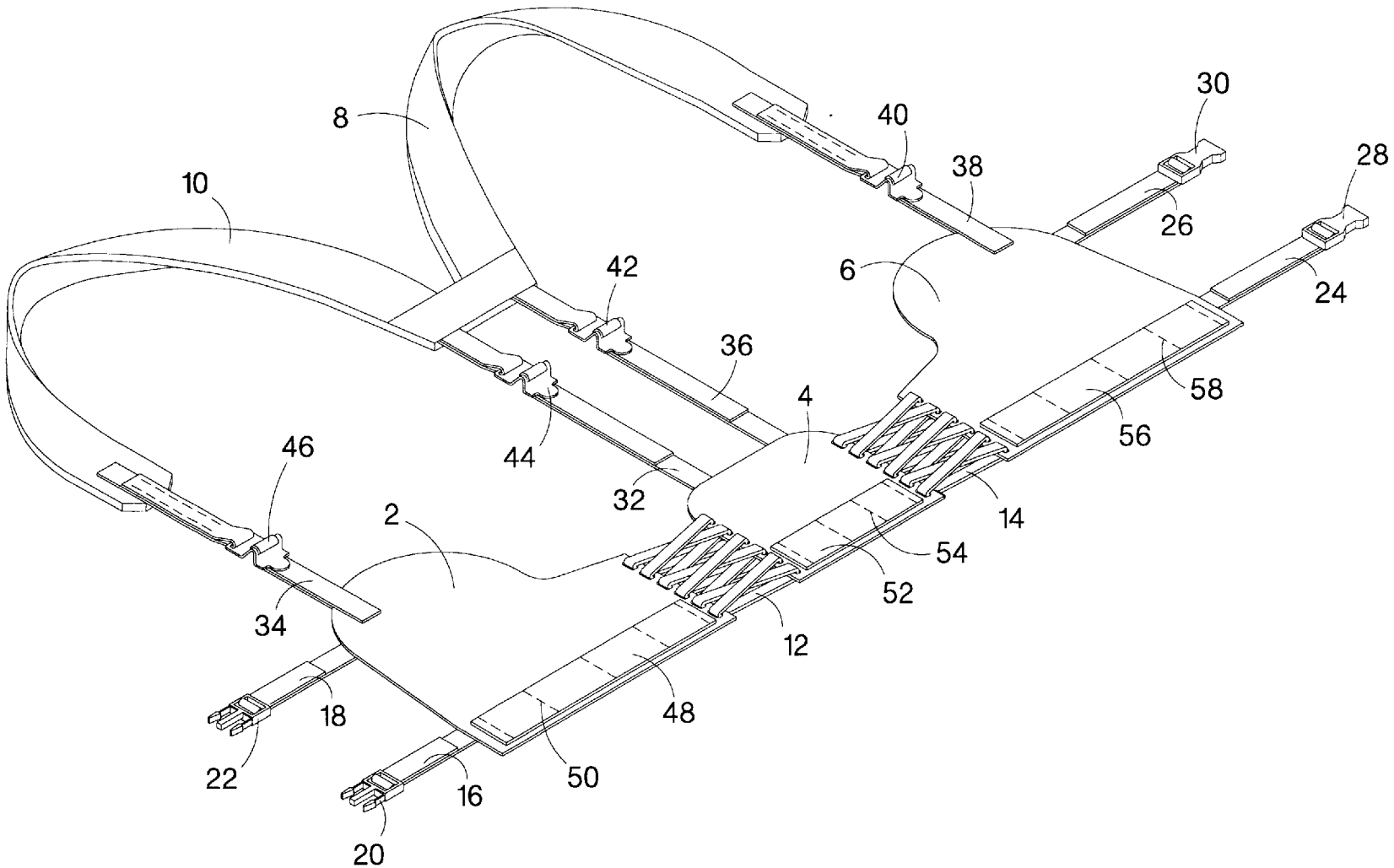
FIG. 2 redepicts the carrier of FIG. 1, showing bottle or can receptacles removed.

Referring now to the drawings, and in particular, simultaneously to FIGS. 1 and 2, the instant inventive janitorial supply carrier is referred to generally by Reference Arrow 1. Back panel 4 and left and right hip panels 2 and 6 are preferably fabricated from a single layer of heavy duty polyester fabric. Polyester is preferably utilized because polyester is characteristically resistant to degradation due to chemical exposure. Lacings 12 and 14 are preferred utilized to adjustably interconnect rearward ends of hip panels 2 and 6 with left and right ends of back panel 4. Such lacings 12 and 14 advantageously allow a wearer of the supply carrier 1 to adjust the distance between panels 2, 4, and 6, and adjust the angular orientation of such panels with respect to each other, allowing the carrier 1 to accommodate various body sizes and shapes.

Referring further to FIGS. 1 and 2, proximal ends of abdomen crossing straps 16, 18, 24, and 26 are preferably fixedly attached by stitching to hip panels 2 and 6. Preferably, distal ends of straps 16, 18, 24, and 26 extend through quick disconnect take up buckles 20, 22, 28, and 30. Configuration of each buckle 20, 22, 28, and 30 to include a take up function advantageously allows accurate centering of back panel 4 over a wearer's back, and allows for centering of buckles over a wearer's abdomen. Suitably, though less desirably, one sided take up buckle combinations (not depicted) may be alternately utilized.

Referring further to FIGS. 1 and 2, left and right shoulder straps 10 and 8 span between and interconnect back panel 4 with hip panels 2 and 6. Preferably, strap and take up buckle combinations 40, 42, 44, and 46 extend from the forward and rearward ends of shoulder straps 8 and 10. Proximal ends of shoulder strap attaching straps 32, 34, 36, and 38 are preferably fixedly attached by stitchings to hip panels 2 and 6 and to back panel 4, the distal ends of such straps adjustably extending through take up buckles 40, 42, 44, and 46.

Referring further to FIGS. 1 and 2, reinforcing straps 48, 52, and 56 are fixedly attached to lower ends of hip panel 2, back panel 4, and hip panel 6 by preferred vertically extending stitchings 50, 54, and 58. The straps 48, 52, and 56 attached by such stitchings 50, 54, and 58 advantageously perform dual functions of reinforcing panels 2, 4, and 6, and forming vertically extending hook or ring engaging channels.

Referring to FIG. 1, at least a first, and preferably a plurality, of bottle or can receptacles 60, 62, 64, 68, 70, and 72 are preferably fixedly, adjustably, and removably attached to, referring further to FIG. 2, the vertically extending channels formed by reinforcing straps 48 and 56, such receptacles being positioned so that bottles or cans contained therein extend downwardly below the lower ends of panels 2 and 6.

Figure 3:
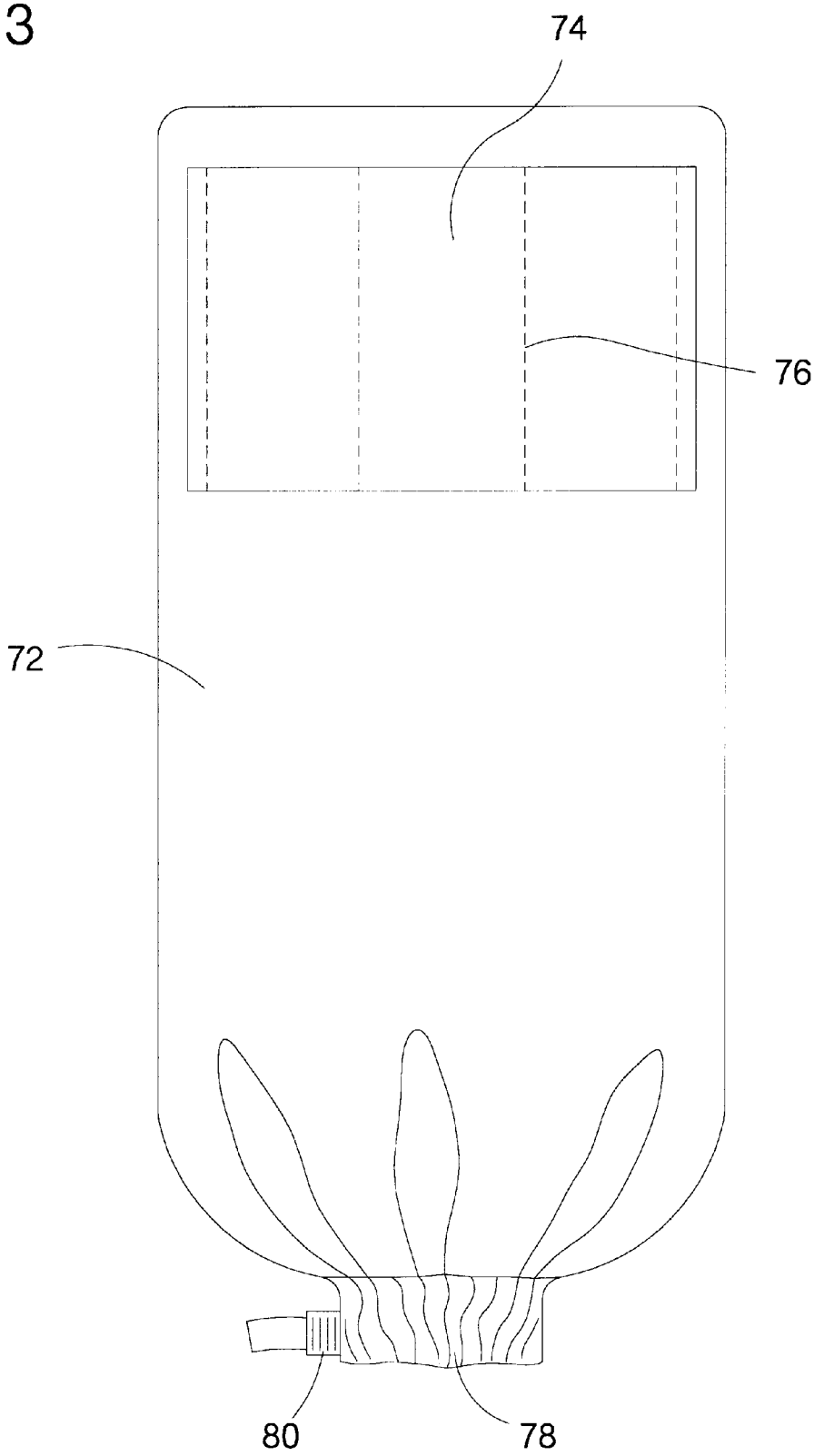
FIG. 3 is a side view of one of the bottle or can receptacles.
Figure 4:
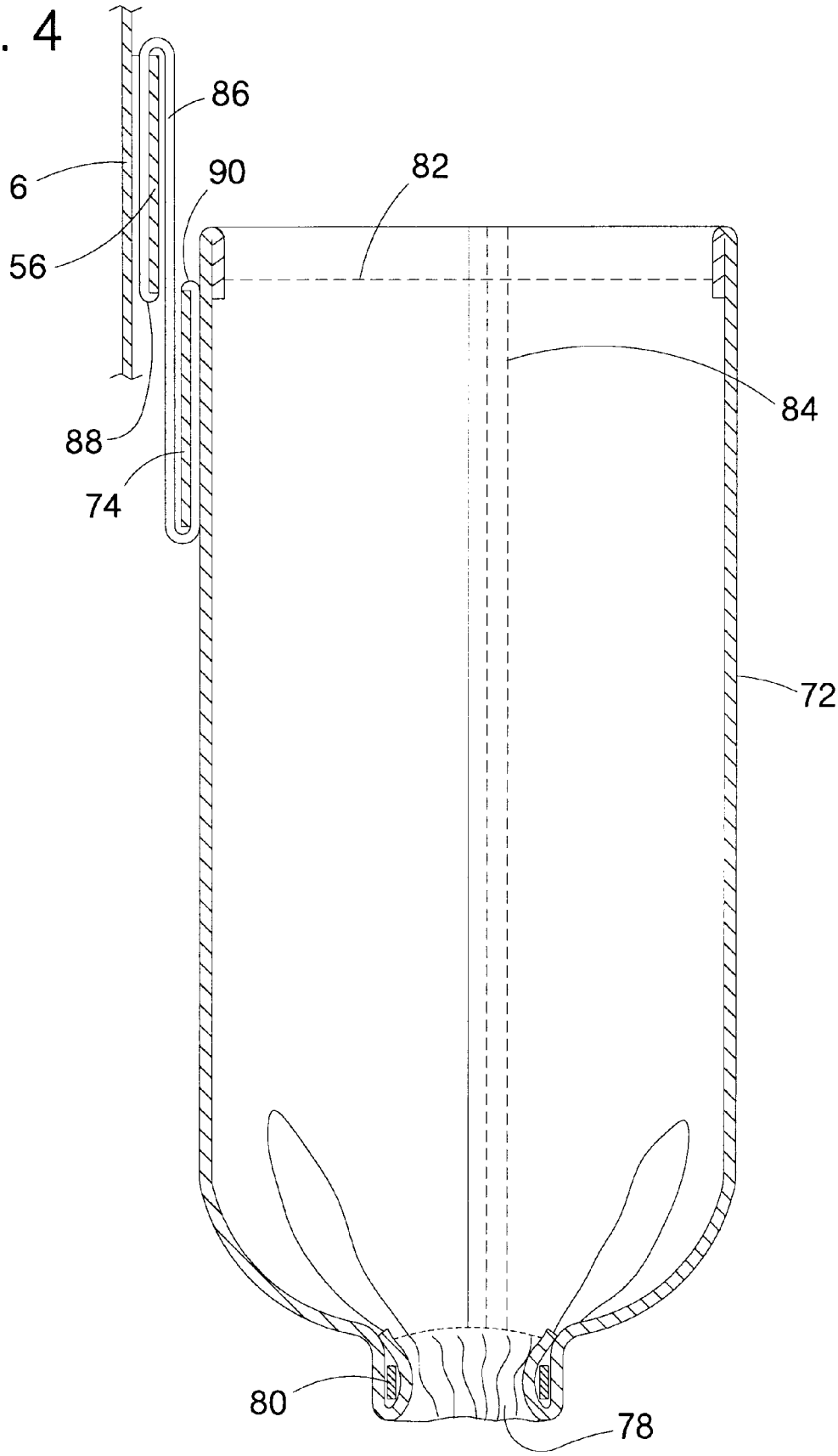
FIG. 4 is a sectional view as indicated in FIG. 1.

Referring simultaneously to FIGS. 3 and 4, bottle or can receptacle 72 preferably comprises polyester fabric sewn in a tubular configuration by seam 84, such tube having upper and lower hems 82 and 78. A hem drawing means, preferably cable tie 80, is extended through hem 78, the cable tie 80 drawing hem 78 annularly inward and downward, forming the floor of receptacle 72. Referring simultaneously to FIGS. 2 and 3, reinforcing strap 74 attached by vertically extending stitches 76 is configured, and functions substantially identically with, referring to FIG. 2, reinforcing straps 48, 52, and 56. Referring simultaneously to FIGS. 2–4, a preferred spring steel or plastic elongated "S" hook 86 extends into a channel formed by reinforcing strap 56, and into a channel formed by reinforcing strap 74. Preferably, the distal ends of the elongated "S" hook 86 have in turned stops 88 and 90 for securing the "S" hook in place. For enhancement of stability, it is desirable that dual, side by side, "S" hooks 86 be utilized for attachment of each of the bottle or can receptacles 60, 62, 64, 68, 70, and 72.

Referring simultaneously to all figures, in use of the inventive janitorial supply carrier 1, a wearer adjusts the depicted straps, buckles, and lacings to assure that the weight of bottles or cans carried within receptacles 60, 62, 64, 68, 70, and 72, is evenly distributed over the wearer's shoulders and hips. By manipulating the lateral positioning of the engagements of elongated "S" hooks 86 within the channels of reinforcing straps 48, 52, and 56, lateral positioning of receptacles 60, 62, 64, 68, 70, and 72 may be adjusted to enhance accessibility to carried bottles or cans. Upon wearing the carrier 1, and upon loading receptacles 60, 62, 64, 68, 70, and 72 with bottles or cans, the wearer-will commonly cause lower surfaces of such receptacles to strike floor, wall, or furniture surfaces. The gathered hem configurations of the lower ends of such receptacles function to protect the fabric of such receptacles from being cut.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A janitorial supply carrier comprising:

(a) a back panel having an outer surface, upper and lower ends, and left and right ends;

(b) left and right hip panels, each having an outer surface, upper and lower ends, and forward and rearward ends;

(c) left and right shoulder straps, each having forward and rearward ends;

(d) first attaching means adjustably interconnecting ends of the back panel, the left and right hip panels, and the left and right shoulder straps;

(e) at least a first reinforcing strap having an inner surface, the at least first reinforcing strap extending laterally across the lower end of the left or right hip panel;

(f) second attaching means interconnecting the at least first reinforcing strap and the left or right hip panel, the outer surface of the left or right hip panel, the second attaching means, and the inner surface of the at least first reinforcing strap in combination defining a plurality of channels;

(g) at least a first upwardly opening bottle or can receptacle, said receptacle having an upper end; and (h) third attaching means removably attaching the upper end of the at least first upwardly opening bottle or can receptacle to the lower end of the left or right hip panel, the third attaching means engaging at least a first channel among the plurality of channels.

2. The janitorial supply carrier of claim 1 wherein the at least first upwardly opening bottle or can receptacle comprises a fabric sleeve having a hemmed lower end, and hem drawing means extending through said hem, said means pulling said hem annularly inward to form a receptacle floor.

3. The janitorial supply carrier of claim 2 wherein the hem drawing means comprises a fastener selected from the group consisting of cable ties and drawstrings.

4. The janitorial supply carrier of claim 1 wherein the first attaching means comprises a fastener selected from the group consisting of strap and take up buckle plate combinations, strap and take up buckle ring combinations, strap and quick disconnect take up buckle combinations, button and buttonhole combinations, velcro hook and velcro pad combinations, strap and snap combinations, and lacings and eyelet combinations.

5. The janitorial supply carrier of claim 4 wherein the second attaching means comprises a fastener selected from the group consisting of stitchings, rivets, staples, heat fusion bonds, and adhesive bonds.

6. The janitorial supply carrier of claim 5 wherein the third attaching means comprises a fastener selected from the group consisting of "S" hooks and locking rings.

7. The janitorial supply carrier of claim 6 further comprising at least a second reinforcing strap and a plurality of second upwardly opening bottle or can receptacles, the second attaching means further interconnecting the at least second reinforcing strap and the left or right hip panel, the third attaching means further removably attaching the plurality of second upwardly opening bottle or can receptacles to the left or right hip panel.

8. The janitorial supply carrier of claim 7 wherein the back panel, and the left and right hip panels comprise polyester fabric.

9. The janitorial supply carrier of claim 3 wherein the first attaching means comprises a fastener selected from the group consisting of strap and take up buckle plate combinations, strap and take up buckle ring combinations, strap and quick disconnect take up buckle combinations, button and buttonhole combinations, velcro hook and velcro pad combinations, strap and snap combinations, and lacings and eyelet combinations.

10. The janitorial supply carrier of claim 9 wherein the second attaching means comprises a fastener selected from the group consisting of stitchings, rivets, staples, heat fusion bonds, and adhesive bonds.

11. The janitorial supply carrier of claim 10 wherein the third attaching means comprises a fastener selected from the group consisting of "S" hooks and locking rings.

12. The janitorial supply carrier of claim 11 further comprising at least a second reinforcing strap and a plurality of second upwardly opening bottle or can receptacles, the second attaching means further interconnecting the at least second reinforcing strap and the left or right hip panel, the third attaching means further removably attaching the plurality of second upwardly opening bottle or can receptacles to the left or right hip panel.

13. The janitorial supply carrier of claim 12 wherein the back panel, and the left and right hip panels comprise polyester fabric.

* * * * *